US012310507B2

(12) United States Patent
Lee et al.

(10) Patent No.: US 12,310,507 B2
(45) Date of Patent: May 27, 2025

(54) AIR POCKET MODULE AND AIR MATTRESS INCLUDING THE SAME

(71) Applicants: Dong Hun Lee, Seoul (KR); Young Jun Yu, Anyang-si (KR)

(72) Inventors: Dong Hun Lee, Seoul (KR); Young Jun Yu, Anyang-si (KR)

( * ) Notice: Subject to any disclaimer, the term of this patent is extended or adjusted under 35 U.S.C. 154(b) by 492 days.

(21) Appl. No.: 17/943,223

(22) Filed: Sep. 13, 2022

(65) Prior Publication Data

US 2024/0081551 A1 Mar. 14, 2024

(51) Int. Cl.
*A47C 27/08* (2006.01)
*A47C 27/10* (2006.01)

(52) U.S. Cl.
CPC ..... *A47C 27/083* (2013.01); *A47C 27/082* (2013.01); *A47C 27/10* (2013.01)

(58) Field of Classification Search
CPC ..... A47C 27/10; A47C 27/082; A47C 27/081; A61G 7/05776
See application file for complete search history.

(56) References Cited

U.S. PATENT DOCUMENTS 4,852,195 A * 8/1989 Schulman ..... A61G 7/05776 297/DIG. 8
6,401,282 B1 * 6/2002 Shum ..... A47C 27/10 5/710
6,550,085 B2 * 4/2003 Roux ..... A47C 27/10 5/944
6,760,937 B1 * 7/2004 Ou ..... A47C 31/005 5/641
7,406,734 B1 * 8/2008 Mai ..... A47C 27/081 5/710
7,571,504 B2 * 8/2009 Kuo ..... A47C 27/15 5/724
2005/0151410 A1 * 7/2005 Sprouse, II ..... A47C 7/144 297/452.41
2014/0059780 A1 * 3/2014 Lafleche ..... A61G 7/05792 5/724
2019/0075931 A1 * 3/2019 Yu ..... A47C 27/10
2019/0075932 A1 * 3/2019 Yu ..... A47C 27/10
2020/0405072 A1 * 12/2020 Yu ..... G16H 20/30

FOREIGN PATENT DOCUMENTS

JP 2016140750 A * 8/2016 ..... A47C 27/08

* cited by examiner

*Primary Examiner* — Eric J Kurilla
(74) *Attorney, Agent, or Firm* — Revolution IP, PLLC

(57) ABSTRACT

An air pocket module (10) inserted into an air mattress (1) includes a plurality of air pockets (100), each of which has a hollow defined therein to be expanded due to air inflow or contracted due to air outflow, and a lower plate (110) coupled below the air pockets (100) to shield the hollow of the air pocket (100). The air pocket (100) includes a top surface part (1100) provided in a regular n-polygonal shape (n is an even integer of 6 or greater) when viewed in a plan view, a connection part (1200) connected to the top surface part (1100), side surface parts (1300), each of which has one end connected to the connection part (1200) to extend downward and the other end connected to the lower plate (110), a side surface part connection part (1400).

11 Claims, 12 Drawing Sheets

[FIG.1]
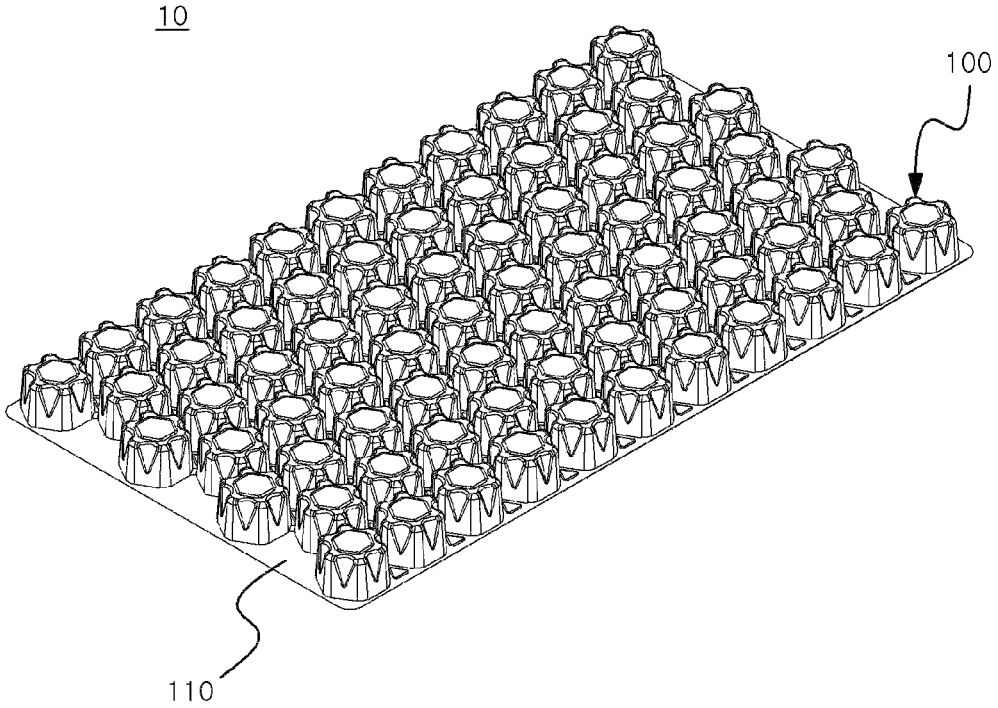

[FIG.2]
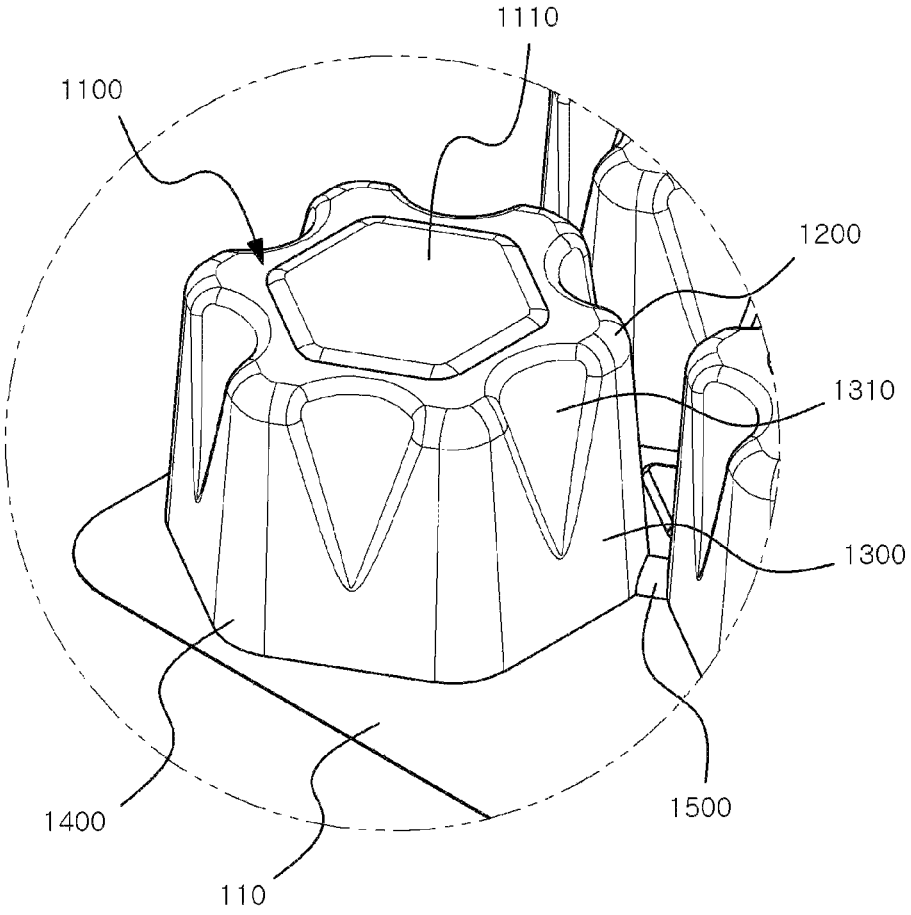

[FIG.3]
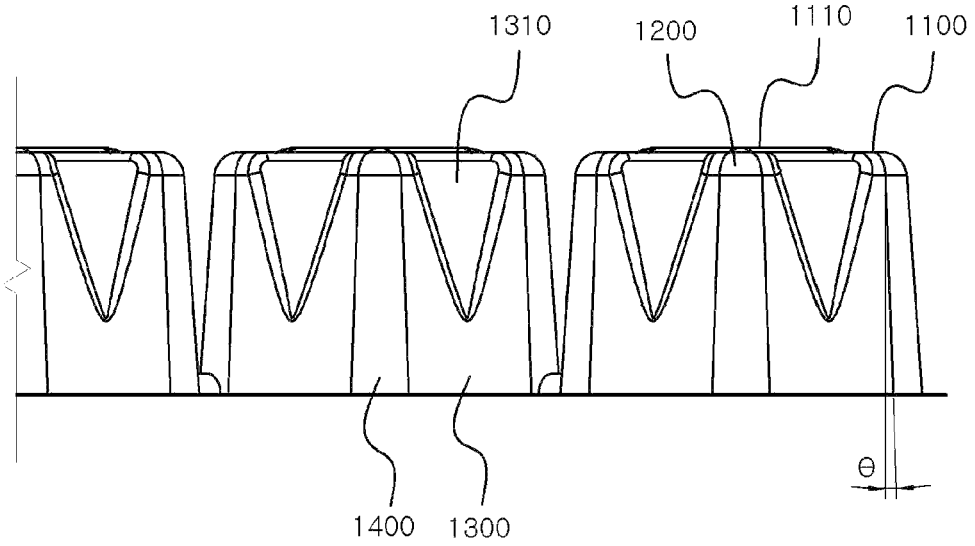

[FIG.4]
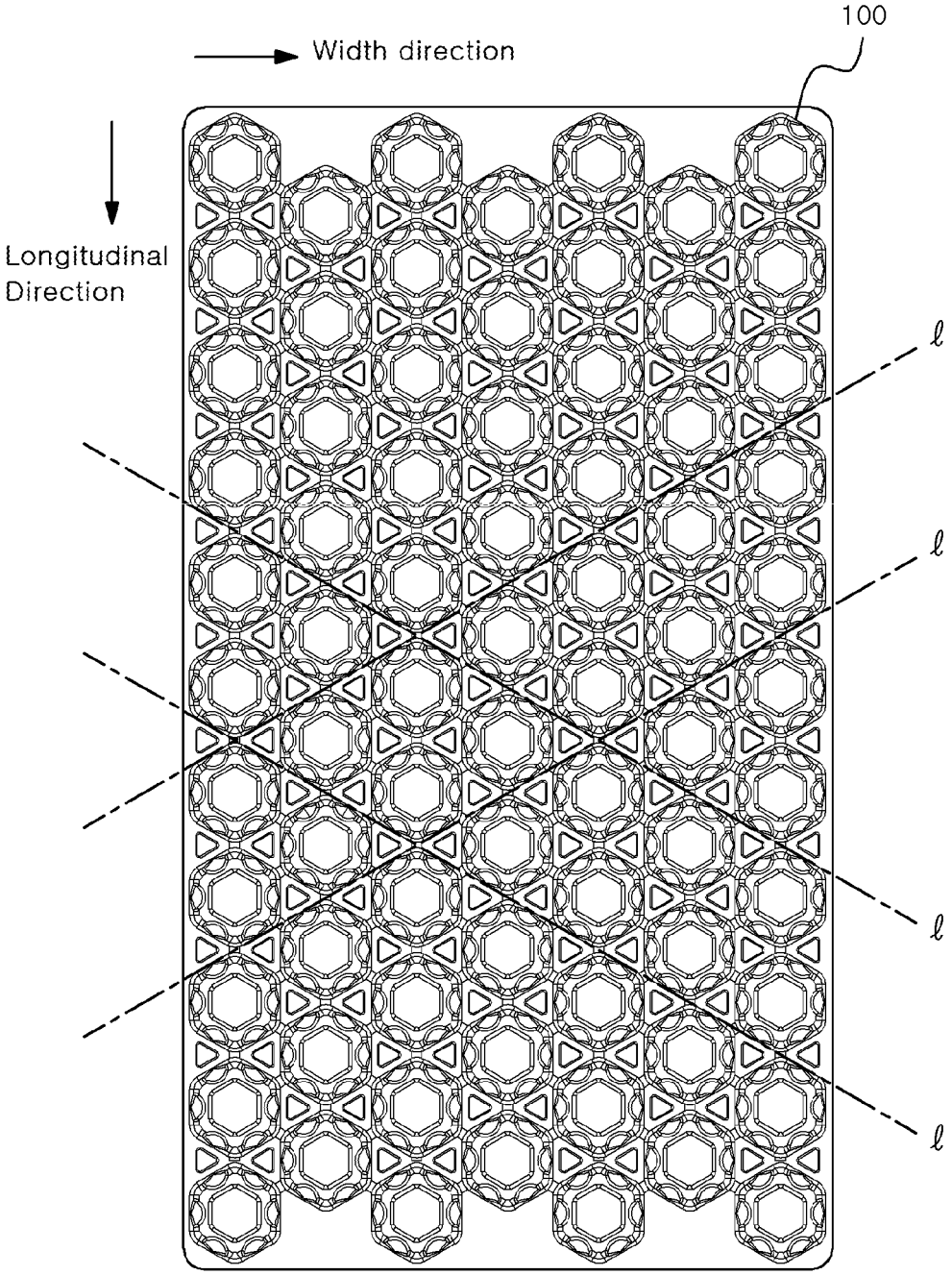

[FIG.5]
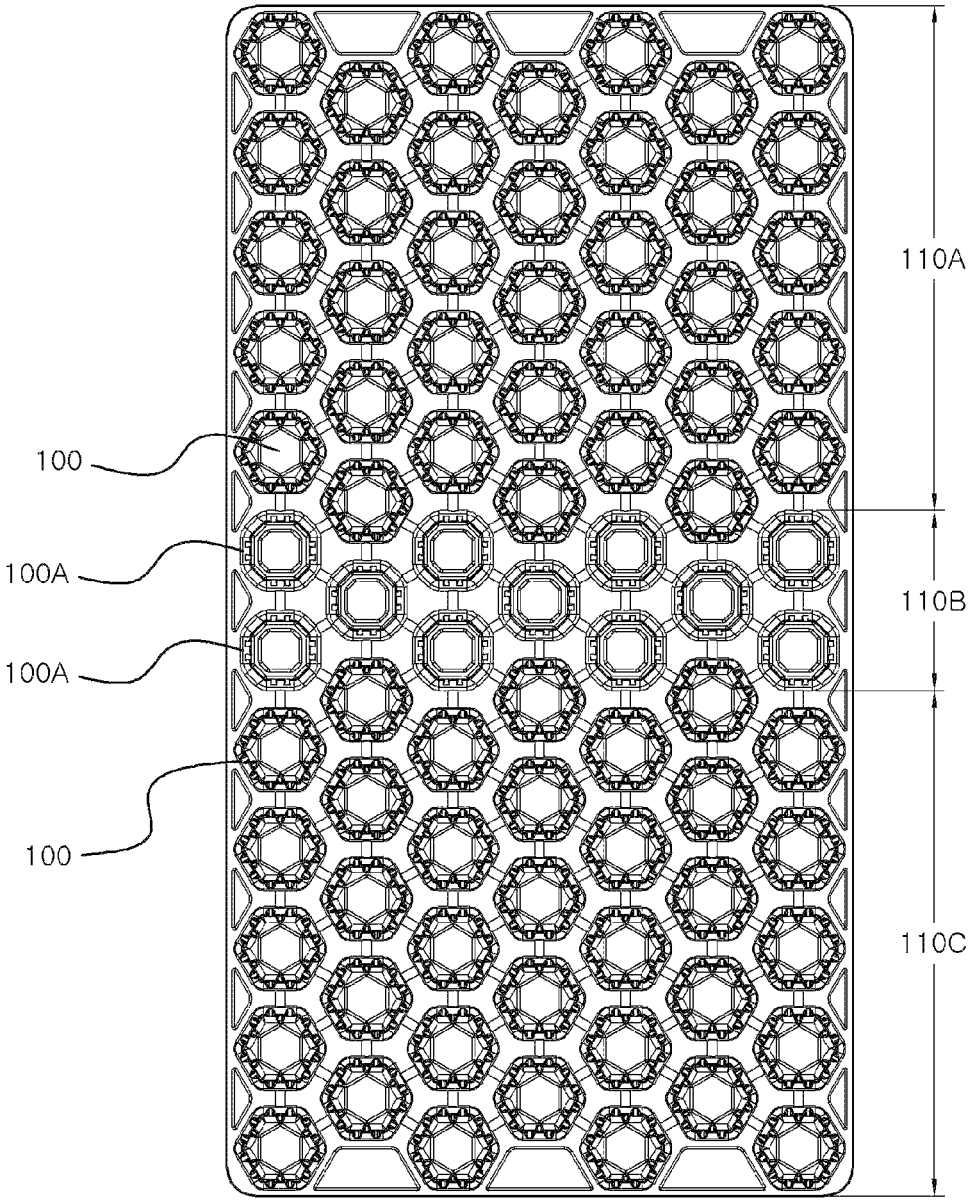

[FIG.6]
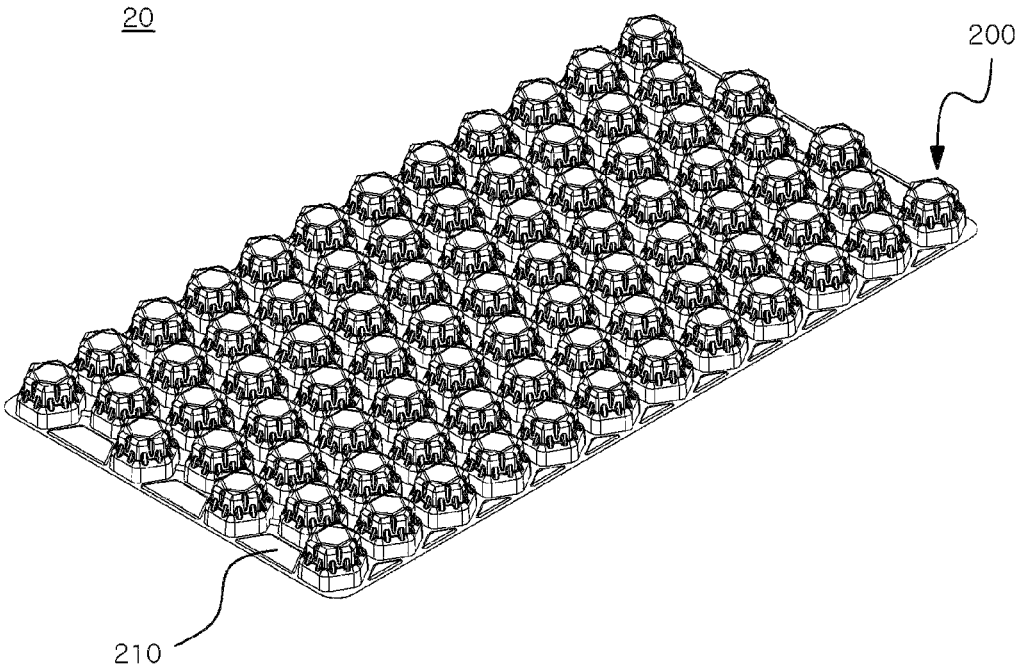

[FIG.7]
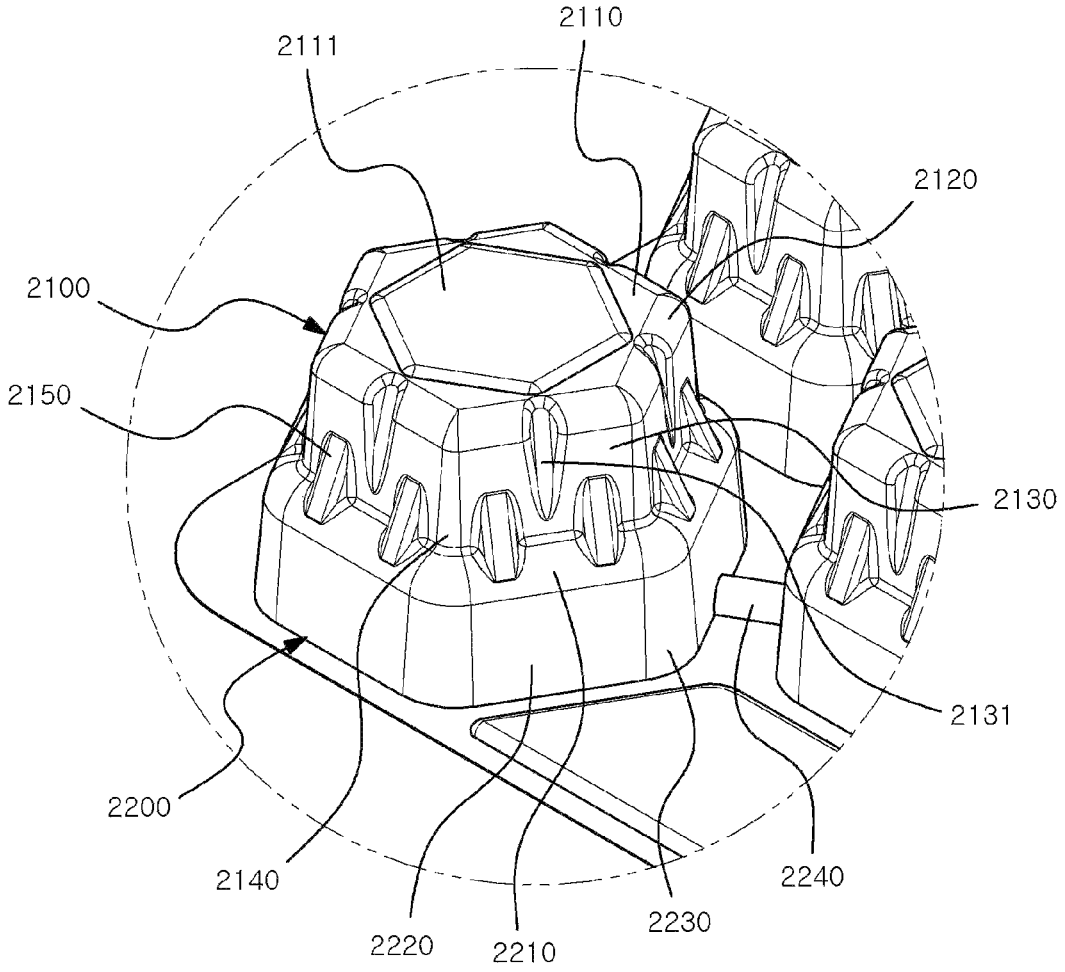

[FIG.8]
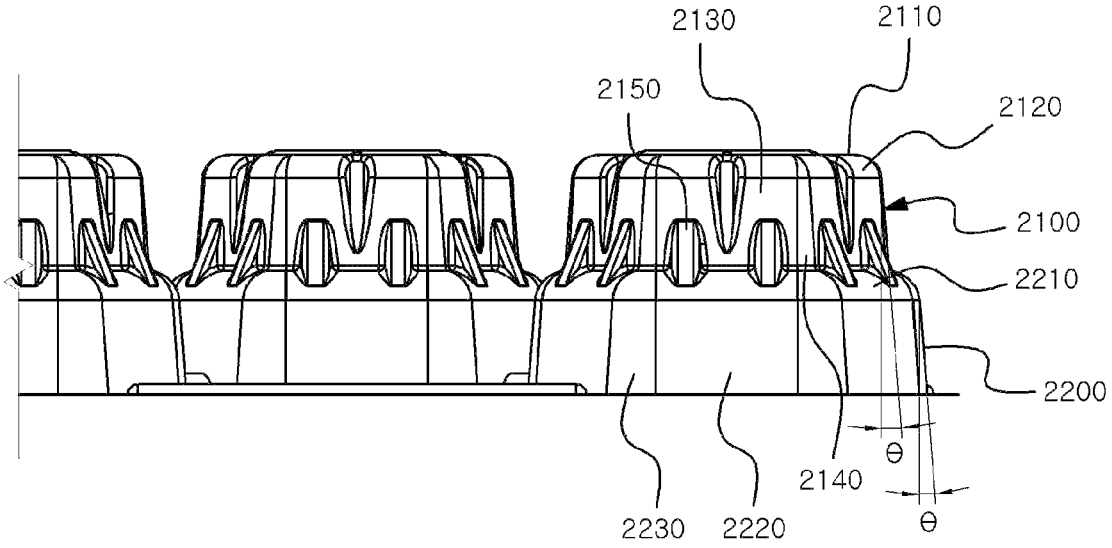

[FIG.9]
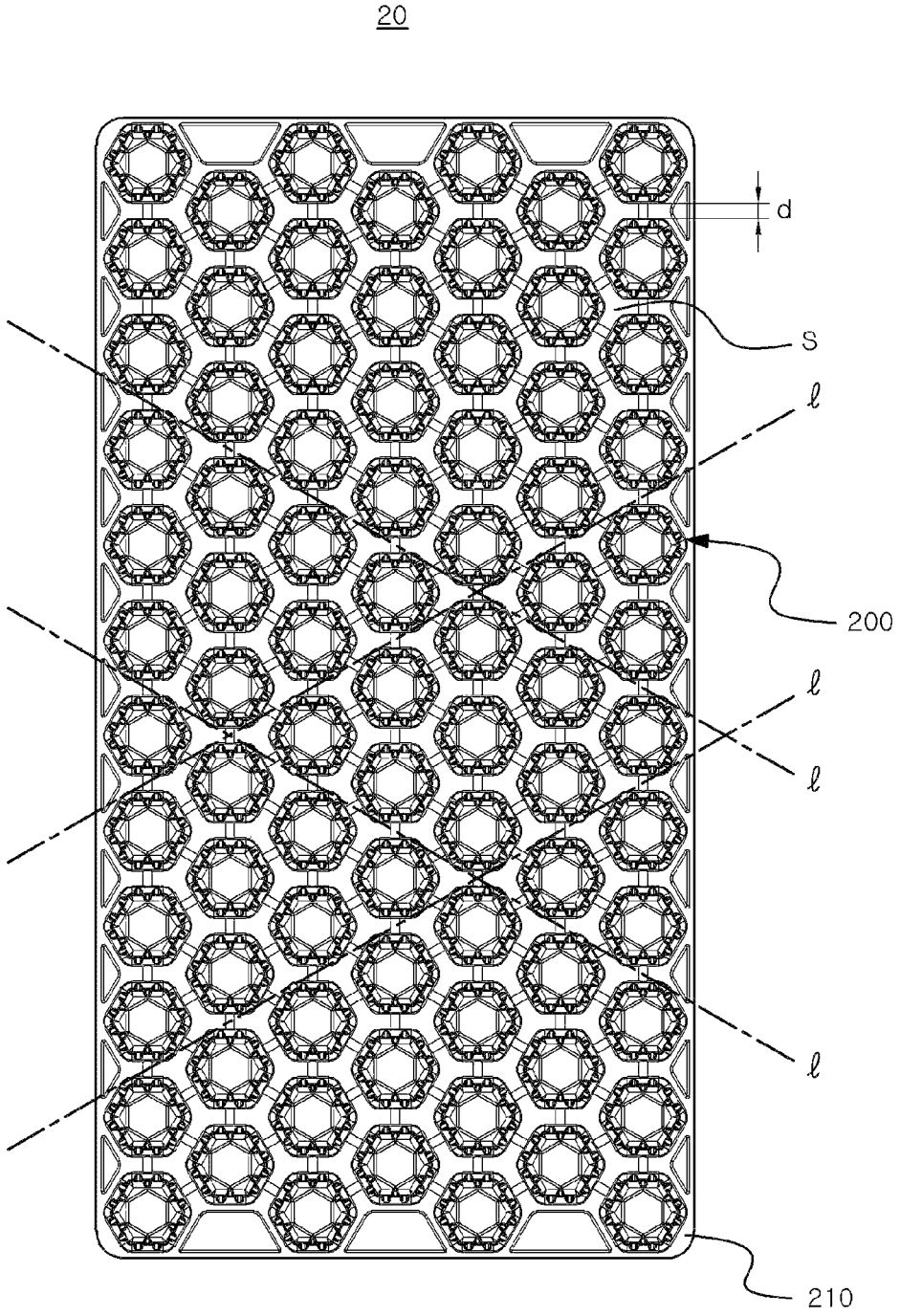

[FIG.10]
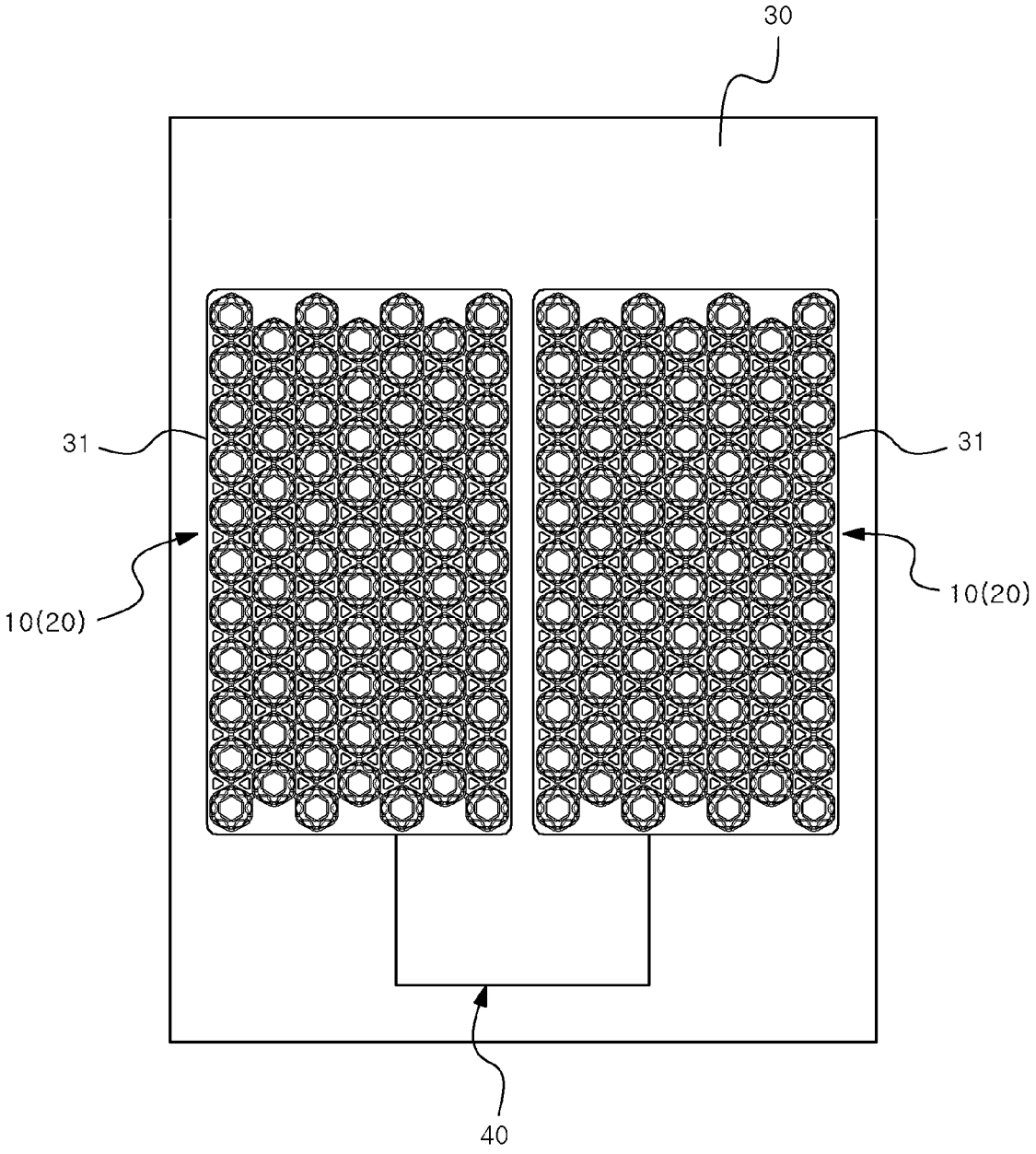

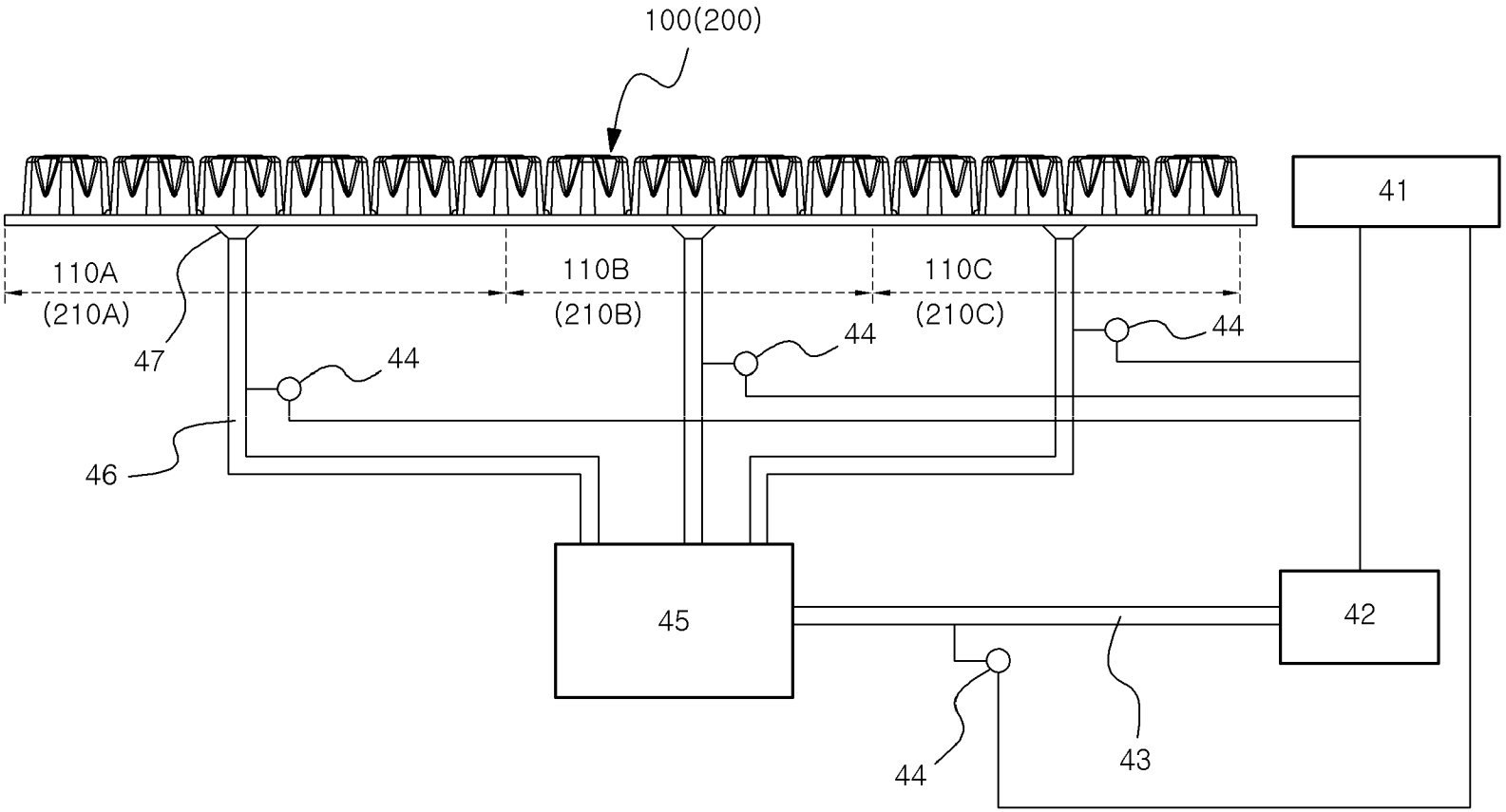
[FIG.11]

[FIG.12]
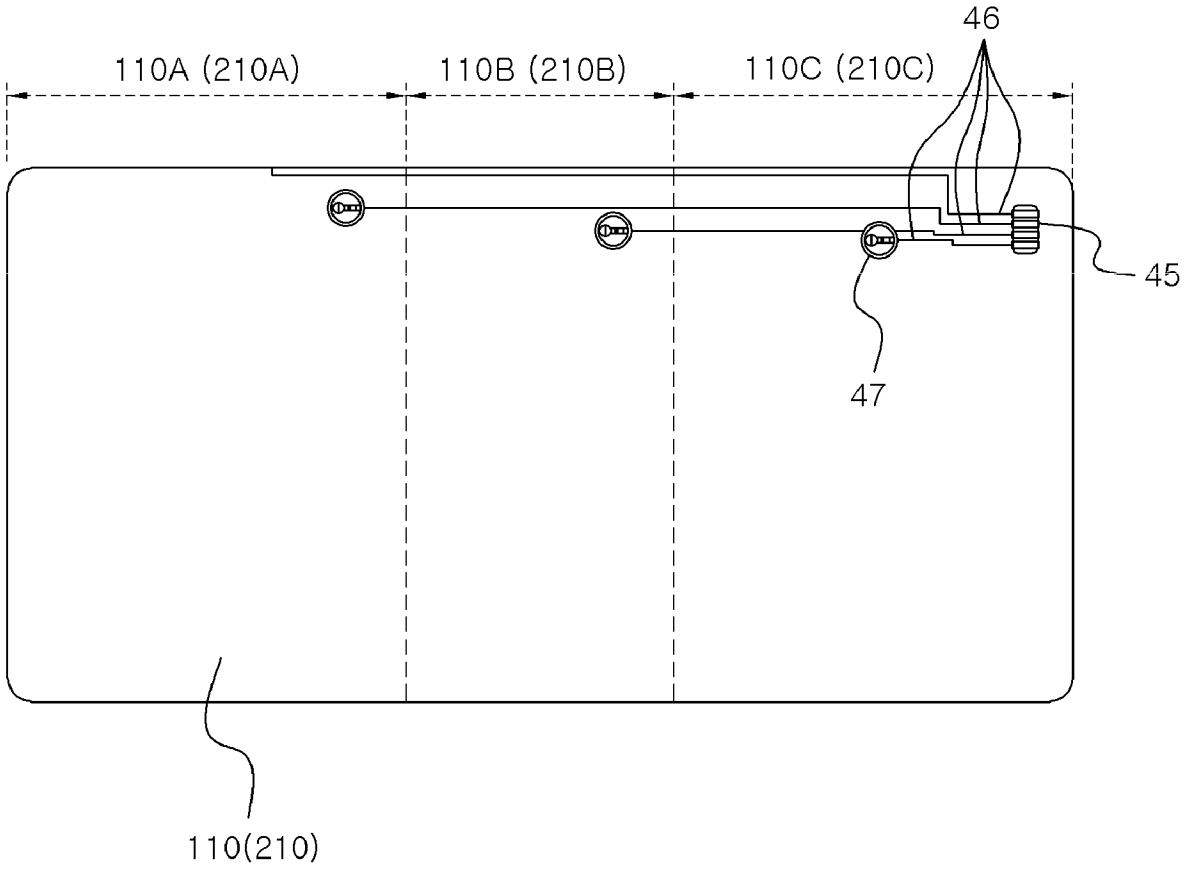

AIR POCKET MODULE AND AIR MATTRESS INCLUDING THE SAME

BACKGROUND

The present invention relates to an air pocket module, which improves a supporting force of an air mattress, and an air mattress including the air pocket module.

In general, a spring mattress having coil springs provided therein is used a lot as a mattress for bed.

In the spring mattress, however, an impact applied to a portion of the mattress is transferred to the surroundings of the portion to cause vibration. The elasticity of the coil springs is collectively set during manufacture, so that a user may not arbitrarily adjust the stiffness of a cushion. Moreover, when the mattress is used for a long time, there is a limitation in that elastic force of the coil spring is reduced.

In order to supplement such a limitation of the spring mattress, an air mattress filled with air is used.

In general, the air mattress has appropriate cushioning through air pressure which is defined inside the air mattress by injecting air.

Such an air mattress includes an air pocket module provided in a form of a plurality of air pockets, a body in which the air pocket module is accommodated, and a pressure controller for adjusting the pressures of the air pockets.

Typically, the air pockets of the air pocket module are defined in a rectangular column shape.

Since the air pockets are provided in a rectangular shape, one of the length and the width is longer than the other to cause inconvenience to a bed user in terms of friction noise and cushioning due to a difference between horizontal and vertical expansion rates.

In addition, the rectangular air pockets are arranged in a grid form, and thus spaces between the air pockets are elongated in a straight line to form an empty space.

Accordingly, the supporting force of the mattress is degraded, and the user feels the empty space and fails to feel uniform support for the overall mattress when using the mattress.

Thus, the air mattress according to the related art has a lot of limitations in terms of the supporting force of the mattress and user comfort, which are the most important aspects of the air mattress for users.

SUMMARY

The present invention provides an air pocket module, which improves comfort of a bed user on an air mattress and further increases in supporting force of the air mattress, and an air mattress including the air pocket module.

An embodiment of the inventive concept provides an air pocket module 10 inserted into an air mattress 1, including a plurality of air pockets 100, each of which has a hollow defined therein to be expanded due to air inflow or contracted due to air outflow, and a lower plate 110 coupled below the air pockets 100 to shield the hollow of the air pocket 100. The air pocket 100 may include a top surface part 1100, which is provided in a regular n-polygonal shape (n is an even integer of 6 or greater) when viewed in a plan view, a connection part 1200 connected to the top surface part 1100, side surface parts 1300, each of which has one end connected to the connection part 1200 to extend downward and the other end connected to the lower plate 110, a side surface part connection part 1400, which connects the side surface parts 1300 to each other, and a bridge 1500 which serves as an air passage between adjacent air pockets 100 on the lower plate 110.

In the air pocket module of the present invention, the air pockets 100 may be disposed to be spaced a predetermined distance d from each other in a longitudinal direction and a width direction, and the air pockets 100 of one row in the longitudinal direction and the air pockets 100 of adjacent one row may be misaligned with each other along the longitudinal direction, so that a plurality of spaced lines 1 between the air pockets 100 are defined as oblique lines to cross each other.

In the air pocket module of the present invention, a contact part 1110 may be disposed in a top surface of the top surface part 1100 to protrude upward, and the contact part 1110 may be provided to have a shape corresponding to the top surface part 1100.

In the air pocket module of the present invention, the side surface part 1300 may extend downward with a uniform width to extend at an angle θ with respect to the outside of the air pocket 100, and the side surface part connection part 1400 may also extend downward to extend at the angle θ with respect to the outside of the air pocket 100.

In the air pocket module of the present invention, a reinforcing part 1310 provided in a shape extending in a height direction may be disposed in the side surface part 1300, and the reinforcing part 1310 may be provided to be recessed inside the side surface part 1300 with a width that gradually decreases from the connection part 1200 toward a lower portion of the side surface part 1300.

In the air pocket module of the present invention, the air pocket 100 provided in a regular n-polygonal column shape (n is an even integer of 6 or greater) may be disposed in each of an upper portion and a lower portion in the longitudinal direction of the lower plate 110, and an air pocket 100A provided in a regular (n+2)-polygonal column shape (n is an even integer of 6 or greater) may be disposed between the upper portion and the lower portion in the longitudinal direction of the lower plate 110.

In an embodiment of the inventive concept, an air pocket module 20 inserted into an air mattress 1 includes a plurality of air pockets 200, each of which has a hollow defined therein to be expanded due to air inflow or contracted due to air outflow, and a lower plate 210 coupled below the air pockets 200 to shield the hollow of the air pocket 200. The air pocket 200 may include an upper air pocket 2100, and a lower air pocket 2200 disposed below the upper air pocket 2100 and provided in a regular polygonal column shape having a size greater than that of the upper air pocket 2100. The upper air pocket 2100 may include an upper top surface part 2110, which is provided in a regular n-polygonal shape (n is an even integer of 6 or greater) when viewed in a plan view, an upper connection part 2120 connected to the upper top surface part 2110, upper side surface parts 2130, each of which has one end connected to the upper connection part 2120 to extend downward and the other end connected to the lower air pocket 2200, and an upper side surface part connection part 2140 which connects the upper side surface parts 2130 to each other. The lower air pocket 2200 may include a lower connection part 2210 connected to the upper side surface part 2130, lower side surface parts 2220, each of which is disposed below the lower connection part 2210, and a lower side surface part connection part 2230 which connects the lower side surface parts 2220 to each other. A bridge 2240 may be provided to serve as an air passage between adjacent air pockets 200 on the lower plate 210.

In the air pocket module of the present invention, the air pockets 200 may be disposed to be spaced a predetermined distance from each other in a longitudinal direction and a width direction, and the air pockets 200 of one row in the longitudinal direction and the air pockets 200 in adjacent one row may be misaligned with each other along the longitudinal direction, so that a plurality of spaced lines 1 between the air pockets 200 are defined as oblique lines to cross each other.

In the air pocket module of the present invention, an upper contact part 2111 may be disposed in a top surface of the upper top surface part 2110 to protrude upward, and the upper contact part 2111 may be provided in a shape corresponding to the upper top surface part 2110.

In the air pocket module of the present invention, the upper side surface part 2130 may extend downward with a uniform width to extend at an angle θ with respect to the outside of the upper air pocket 2100, and the upper side surface part connection part 2140 may also extend downward to extend at the angle θ with respect to the outside of the upper air pocket 2100.

In the air pocket module of the present invention, an upper reinforcing part 2131 provided in a shape extending in a height direction may be disposed in the upper side surface part 2130, and the upper reinforcing part 2131 may be provided to be recessed inside the upper side surface part 2130 with a width that gradually decreases from the upper connection part 2120 toward a lower portion of the upper side surface part 2130.

In the air pocket module of the present invention, a rib 2150 may be disposed between the upper side surface part 2130 and the lower connection part 2210 to protrude while extending in the height direction.

In the air pocket module of the present invention, the lower side surface part 2220 may extend downward with a uniform width to extend at an angle θ with respect to the outside of the lower air pocket 2200, and the lower side surface part connection part 2230 may also extend downward to extend at the angle θ with respect to the outside of the lower air pocket 2200.

In the air pocket module of the present invention, the air pocket 200 provided in a regular n-polygonal column shape (n is an even integer of 6 or greater) may be disposed in each of an upper portion and a lower portion in the longitudinal direction of the lower plate 210, and the air pocket 200 provided in a regular (n+2)-polygonal column shape (n is an even integer of 6 or greater) may be disposed between the upper portion and the lower portion in the longitudinal direction of the lower plate 210.

In the air pocket module of the present invention, the n may be 6.

In an embodiment of the inventive concept, an air mattress provided with the air pocket module of the present invention includes a body 30 in which the air pocket module is accommodated, and an air pressure controller 40 which controls a pressure of the air pocket module. The body 30 may accommodate one or more air pocket modules. The air pressure controller 40 may include a controller 41 installed in the body 30, an air pump 42 connected to and controlled by the controller 41, a discharge line 43, which delivers air discharged from the air pump 42, a valve part 45 connected to the discharge line 43, supply lines 46, each of which is connected to the valve part 45, and a nozzle 47 connected to the supply line 46 and installed in the lower plate to serve as an inlet through which the air is supplied to the air pocket.

The air mattress of the present invention may further include a pressure sensor 44 installed in the discharge line 43 or each of the supply lines 46 so as to be connected to the controller 41.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings:

FIG. 1 is a perspective view illustrating an entirety of an air pocket module according to a first embodiment of the present invention;

FIG. 2 is a perspective view illustrating a single air pocket according to the first embodiment of the present invention;

FIG. 3 is a front view illustrating the air pocket module according to the first embodiment of the present invention;

FIG. 4 is a plan view illustrating the air pocket module according to the first embodiment of the present invention;

FIG. 5 is a plan view illustrating another example of the air pocket module according to the first embodiment of the present invention;

FIG. 6 is a perspective view illustrating an entirety of an air pocket module according to a second embodiment of the present invention;

FIG. 7 is a perspective view illustrating a single air pocket according to the second embodiment of the present invention;

FIG. 8 is a front view illustrating the air pocket module according to the second embodiment of the present invention;

FIG. 9 is a plan view illustrating the air pocket module according to the second embodiment of the present invention;

FIG. 10 is a plan view illustrating an air mattress according to an embodiment of the present invention;

FIG. 11 is a view illustrating a state in which a control device is installed in the air mattress according to an embodiment of the present invention; and FIG. 12 is a view illustrating a lower plate in the air mattress according to an embodiment of the present invention.

DETAILED DESCRIPTION

Hereinafter, embodiments of the present invention will be described with reference to the accompanying drawings.

First Embodiment

FIG. 1 is a perspective view illustrating an entirety of an air pocket module according to a first embodiment of the present invention. FIG. 2 is a perspective view illustrating a single air pocket according to the first embodiment of the present invention. FIG. 3 is a front view illustrating the air pocket module according to the first embodiment of the present invention. FIG. 4 is a plan view illustrating the air pocket module according to the first embodiment of the present invention.

An air pocket module 10 of the present invention includes air pockets 100 and a lower plate 110 installed below the air pockets 100.

In the first embodiment of the air pockets of the present invention, the air pockets 100 are defined in a single level.

In the first embodiment, each of the air pockets 100 includes a top surface part 1100, which has a regular hexahedronal shape as seen on a plane, connection parts 1200, which are connected to the top surface part 1100, side surface parts 1300, each of which has one end connected to each of the connection parts 1200 and the other end connected to the lower plate 110, and side surface part connection parts 1400, each of which connects the side surface parts 1300 to each other.

The top surface part 1100 has a regular hexahedronal shape as seen on a plane, and a contact part 1110 is disposed within a top surface of the top surface part 1100 to protrude upward.

The contact part 1110 is provided in a regular hexagonal shape to correspond to the top surface part 1100 having the regular hexagonal shape.

The connection part 1200 connects the top surface part 1100 and the side surface part 1300 in the form of a curve.

The side surface part 1300 extends downward with a uniform width and may extend at an angle θ with respect to the outside of the air pocket 100 so as to further improve the supporting force.

A reinforcing part 1310 in a form extending in a height direction is disposed on each of the side surface parts 1300.

The reinforcing part 1310 is provided to be recessed inside the side surface part 1300 with a width which gradually decreases from the connection part 1200 toward a lower portion of the side surface part 1300.

The side surface part connection part 1400 connects adjacent side surface parts 1300 in the form of a curve.

When the side surface part 1300 has the angle θ formed downward with respect to the outside of the air pocket 100, the side surface part connection part 1400 is also provided to extend downward at the angle θ with respect to the outside of the air pocket 100.

Thus, in the present invention, when the side surface part 1300 is provided to have the angle θ, the air pocket 100 is provided in a regular hexagonal column shape with a cross-sectional area that gradually increases in a downward direction.

In a bottom surface of each of the air pockets 100, a bridge 1500 connects adjacent air pockets 100 to serve as an air passage.

The air pocket 100 of the present invention is provided in a column shape having a regular n-polygonal cross-section (n is an even integer of 6 or greater).

Since the air pocket 100 is provided in a shape of a regular polygon, sides constituting the regular polygon have the same length and angle.

This embodiment relates to a regular hexagonal column shape, but is not limited thereto because the present invention relates to a regular polygonal column shape. The air pocket 100 may be provided in a symmetric polygonal column shape such as a regular octagonal column shape (see FIG. 5) or a regular decagonal column shape, as long as having the same angle and side.

In the air pocket module 10, the air pockets 100 are disposed to be spaced a predetermined distance from each other in a longitudinal direction and a width direction.

The air pocket 100 may be arranged so that a corner thereof is disposed in an upward direction as illustrated in FIG. 4, or a side thereof is disposed in the upward direction as illustrated in FIG. 5.

The air pockets 100 of one row in the longitudinal direction of the air pockets 100, and the air pockets 100 of adjacent one row, are misaligned with each other along the longitudinal direction.

Thus, a plurality of spaced lines 1 between the air pockets are provided as oblique lines in directions crossing each other.

Hereinafter, operation effects of this embodiment will be described.

When the bed user lies on the air mattress, a load is applied to the air pockets in a downward direction.

The contact part 1110 serves as a cushion while initially receiving the load of the user and receives a load pressure as the side surface parts 1300 expand when the continuous load is applied.

Here, the reinforcing part 1310 disposed on the side surface part 1300 prevents the side surface part 1300 from excessively expanding and serves to support the load.

In the present invention, the air pocket in a regular hexahedronal column shape, which supports the load of the bed user, has sides, each of which becomes shorter when compared to the quadrangular column shape according to the related art, so that the area of the side surface part 1300 is reduced to be advantageous in terms of prevention of expansion of the side surface part.

In addition, since the air pocket is provided in a regular polygonal shape such as a regular hexagon, the number of the side surface parts increases by two or more compared to the air pocket in a quadrangular shape, so that there is an effect that the supporting force against a down force applied to the air pockets more increases.

Consequently, the air pocket of the present invention has effects of preventing the expansion of the side surface parts and further improving the supporting force against the load applied in the downward direction.

In this embodiment, the air pocket 100 is provided in a regular hexahedronal column shape. The regular hexahedronal column shape has a structure which may be seen in a honeycomb, a snowflake, graphine that is a carbon structure in a very thin form, etc., and is known to most uniformly distribute power to perform a stably supporting function and be effective in an action operated in the downward direction.

The air pocket of the present invention is provided in a regular hexahedronal column shape to serve to stably and uniformly support the pressure applied in the downward direction due to the weight of the user.

In the air pocket module 10, the air pockets 100 of one row in the longitudinal direction of the air pockets 100, and the air pockets 100 of adjacent one row, are misaligned with each other along the longitudinal direction, so that the plurality of spaced lines 1 between the air pockets are provided as oblique lines in directions crossing each other.

Accordingly, distances between the air pockets are uniformly defined over the entirety of the air mattress, and the bed user feels the uniform supporting force over the entirety of the mattress to have comfort.

When the side surface parts 1300 are inclined (θ) outward, the air pocket 100 according to the present invention has a lower cross-sectional area greater than an upper cross-sectional area, so that there is an effect that the supporting force against the downward load is improved.

In addition, since the upper cross-sectional area of the air pocket is small, there is an effect that even when the air pockets receive the load and the side surface parts expand, adjacent side surface parts are prevented from being in contact with each other to prevent friction noise from occurring during using the bed.

When air pockets in a quadrangular shape are used, like the related art, the air pockets are arranged in a grid shape, and thus spaces between the air pockets are defined in a grid form to fail to provide sufficient support for the user who uses the bed.

FIG. 5 is a plan view illustrating another example of the air pocket module according to the first embodiment of the present invention.

In another example of the first embodiment of the present invention, a zone of the air pocket module 10 may be divided, in the longitudinal direction, into a first zone 110A, a second zone 110B, and a third zone 110C so that air pockets 100A in a regular octagonal column shape are disposed in the second zone 110B, and the air pockets 100 in a regular hexahedronal column shape are disposed in the first zone 110A and the third zone 110C.

Each of the air pockets 100A having a regular octagonal column shape has shorter sides than and has side surfaces two more than the air pocket 100 in a regular hexahedronal column shape, and thus are more advantageous in terms of the supporting force.

Therefore, the air pockets having a regular octagonal column shape, which are more advantageous in terms of the supporting force, are disposed in the zone, in which the butt under the highest load pressure in the body is supported, so that the overall supporting force is uniformly exerted for the user to feel support and comfort.

The advantageous operation effects of the air pockets according to the first embodiment of the present invention are as follows.

First, when compared to the quadrangular columnar shape according to the related art, each of the sides may be reduced in length to reduce the aera of the side surface part, and thus, the air pockets are advantageous in terms of the prevention of the expansion.

Since the air pocket is provided in the regular polygonal shape such as the regular hexagon, the number of side surface parts may increase by two or more to provide the effect that the supporting force against the down force applied to the air pockets more increases.

That is, the air pocket according to the present invention may have the effects of preventing the side surface parts from being expanded and further improving the supporting force against the load applied in the downward direction.

Second, the side surfaces may be provided to be inclined (θ) outward, and thus the air pocket 100 according to the present invention may have the lower cross-sectional area greater than the upper cross-sectional area, so that there is the effect that the supporting force against the downward load is improved.

In addition, since the upper cross-sectional area of the air pocket is small, there may be the effect that even when the air pockets receive the load, and the side surface parts are expanded, the adjacent side surface parts may be prevented from being in contact with each other to prevent the friction noise from occurring during using the bed.

Third, in the air pocket module 10, the air pockets 100 of the one row in the longitudinal direction of the air pockets 100 and the air pockets 100 of the adjacent one row, may be misaligned with each other along the longitudinal direction.

Accordingly, the plurality of spaced lines 1 between the air pockets may be provided as the oblique lines in directions crossing each other so that the distances between the air pockets are uniformly defined over the entirety of the air mattress and the bed user feels comfort.

That is, the air pockets according to the present invention may serve to prevent the absence of the support feels which is feels by the user due to the regular grid spacing in the grid shape in which the distance between the air pockets in the quadrangular shape according to the related art is defined.

Fourth, when the air pockets in the regular hexagonal column shape are disposed in the upper portion and the lower portion in the longitudinal direction of the air pocket module and the air pockets in the regular octagonal column shape are disposed in the middle between the upper portion and the lower portion in the longitudinal direction, the supporting force may be further greatly exerted on the butt under the highest load pressure in the body.

Thus, there may be the effect that when the bed user lies on the bed, the uniform supporting force is generated over the entirety of the mattress to increase the comfort of the user

Second Embodiment

FIG. 6 is a perspective view illustrating an entirety of an air pocket module according to a second embodiment of the present invention. FIG. 7 is a perspective view illustrating a single air pocket according to the second embodiment of the present invention. FIG. 8 is a front view illustrating the air pocket module according to the second embodiment of the present invention. FIG. 9 is a plan view illustrating the air pocket module according to the second embodiment of the present invention.

An air pocket module 20 according to a second embodiment of the present invention includes air pockets 200 and a lower plate 210 disposed below the air pockets 200.

The air pockets 200 according to the second embodiment are provided in two levels to include an upper air pocket 2100 and a lower air pocket 2200 disposed below the upper air pocket 2100.

Each of the upper air pocket 2100 and the lower air pocket 2200 is provided in a regular hexahedronal column shape, and the regular hexahedron of the lower air pocket 2200 is larger than the regular hexahedron of the upper air pocket 2100.

The upper air pocket 2100 includes an upper top surface part 2110 having a regular hexahedronal shape as seen on a plane, upper connection parts 2120 connected to the upper top surface part 2110, upper side surface parts 2130, each of which has one end connected to each of the upper connection parts 2120 and the other end connected to the lower air pocket 2200, and upper side surface part connection parts 2140, each of which connects the upper side surface parts 2130 to each other.

The upper top surface part 2110 has a regular hexahedronal shape as seen on a plane, and an upper contact part 2111 is disposed within a top surface of the upper top surface part 2110 to protrude upward.

The upper contact part 2111 is provided in a regular hexagonal shape to correspond to the upper top surface part 2110 having a regular hexagonal shape.

The upper connection part 2120 connects the upper top surface part 2110 and the upper side surface part 2130 in the form of a curve.

The upper side surface part 2130 extends downward with a uniform width and may extend at an angle θ with respect to the outside of the upper air pocket 2100 so as to further improve the supporting force like the first embodiment.

An upper reinforcing part 2131 in a form extending in a height direction is disposed on the upper side surface part 2130.

The upper reinforcing part 2131 is provided to be recessed inside the upper side surface part 2130 with a width which gradually decreases from the upper connection part 2120 toward a lower portion of the upper side surface part 2130.

The upper side surface part connection part 2140 connects adjacent upper side surface parts 2130 in the form of a curve.

When the upper side surface part 2130 has the angle θ formed downward with respect to the outside of the upper air pocket 2100, the upper side surface part connection part 2140 is also provided to extend downward at the angle θ with respect to the outside of each of the air pockets 200.

Ribs 2150 are disposed between the upper side surface part 2130 and a lower connection part 2210 to protrude while extending in the height direction.

The lower air pocket 2200 includes lower connection parts 2210, which are respectively connected to the upper side surface parts 2130, lower side surface parts 2220, which are respectively disposed below the lower connection parts 2210, and lower side surface part connection parts 2230, each of which connects the lower side surface parts 2220 and thus has a regular hexagonal column shape as a whole.

The lower side surface parts 2220 and the lower side surface part connection parts 2230 are each also provided to have the angle θ with respect to the outside of the lower air pocket 2200.

In the second embodiment, each of the upper air pocket 2100 and the lower air pocket 2200 is described as one in a regular hexahedronal column shape, but is not limited thereto.

Like the first embodiment, the upper air pocket 2100 and the lower air pocket 2200 are provided in a column shape having a regular n-polygonal cross-section (n is an even integer of 6 or greater).

When viewed in the plan view of the air pocket module 20, the configuration in arrangement of the air pocket 20 may be equally applied to that in the first embodiment.

That is, also in the air pocket module 20, the air pockets 200 are disposed to be spaced a predetermined distance from each other in a longitudinal direction and a width direction as seen on a plane. The air pockets 200 of one row in the longitudinal direction of the air pockets 200, and the air pockets 200 of adjacent one row, are misaligned with each other along the longitudinal direction. Thus, a plurality of spaced lines 1 between the air pockets are provided as oblique lines in directions crossing each other.

Like the other example of the first embodiment, the air pockets in a regular octagonal column shape may be disposed in a middle portion in a longitudinal direction of the air pocket module 20, and the air pockets in a regular hexahedronal column shape may be disposed in upper and lower portions in the longitudinal direction.

All of the operation effects of the first embodiment are applied to operation effects of the second embodiment.

In particular, the air pocket module 20 of the second embodiment has the air pockets provided in two levels in the height direction to have an operation effect of providing more comfort for the bed user due to two-stage impact absorption.

In terms of the supporting force of the air mattress, the air pocket is provided as a two-levelled air pocket having the ribs 2150 disposed between the upper air pocket 2100 and the lower air pocket 2200, so that the supporting force is exerted in two levels to bring about an effect of further improving the supporting force of the mattress.

In particular, the air pockets 200 are provided in two levels in the height direction so that an inner space of the air pocket increases with respect to the same planar area to be more advantageous in terms of the supporting force.

The advantageous operation effects of the air pockets according to the second embodiment of the present invention are as follows.

First, all of the operation effects of the air pockets according to the first embodiment may be equally applied to the air pockets according to the second embodiment.

Second, in the case of the air pocket module 20 according to the second embodiment, since the air pockets are provided in the two levels in the height direction, there may be the operation effect of providing more comfort for the bed user due to the two-stages impact absorption.

In terms of the supporting force of the air mattress, the air pocket is provided as the two-levelled air pocket having the ribs 2150 disposed between the upper air pocket 2100 and the lower air pocket 2200, so that the supporting force is exerted in the two levels to bring about the effect of further improving the supporting force of the mattress.

Third, the air pockets 200 may be provided in the two levels in the height direction so that the inner space of the air pocket increases with respect to the same planar area to be more advantageous in terms of the supporting force.

FIG. 10 is a plan view illustrating an air mattress according to an embodiment of the present invention.

An air mattress 1 of the present invention includes an air pocket module 10, a body 30 for accommodating the air pocket module 10 or 20, and an air pressure controller 40 connected to the air pocket module 10 or 20 to adjust pressures of air pockets 100.

The body 30 may be made of a wood material or a resin material and has a top surface in which an accommodation part 31 for accommodating the air pocket module 10 or 20 is defined.

Depending on the size of the bed, one or more air pocket modules 10 or 20 may be installed in the body 30.

The air pressure controller 40 includes a controller 41 installed in the body 30, an air pump 42 connected to the controller 41, a pressure sensor 44 for detecting an air pressure discharged from the air pump 42, a valve part 45 connected to a discharge line 43, supply lines 46 connected to the valve part 45, and nozzles 47 connected to the supply lines 46 and installed in a lower plate 110 to serve as inlets for supplying air to the air pockets 100 or 200.

The controller 41 controls the air pump 42 to supply the air pressures to the air pockets 100 or 200 and controls the air pump 42 so that a pressure value of air supplied depending on an air pressure value detected by the pressure sensor 44 is appropriated.

When the pressures of the air pockets 100 or 200 are controlled as a whole, only one pressure sensor 44 is installed in the discharge line 43, which connects the air pump 42 and the valve part 45, to be electrically connected to the controller 41.

Alternatively, when the pressures of the respective supply lines 46 are individually controlled, a plurality of pressure sensors 44 are installed in the supply lines 46 respectively, to be electrically connected to the controller 41.

The valve part 45 may be constituted by one or more valves. When a plurality of valves are provided, the plurality of valves are provided to respectively correspond to the supply lines 46.

The nozzles 47 are installed in the lower plate 110 to serve to supply air to the air pockets 100 or 200.

In the air mattress of the present invention, when the air pocket module 10 or 20 is divided into a plurality of zones such as a first zone 110A, a second zone 110B, and a third zone 110C, the pressure sensors 44 respectively installed in the supply lines 46 may detect the air pressures and control the valves 45 to individually control pressures for each zone.

Although the embodiments of the present invention have been described, it is understood that various changes and modifications can be made by one ordinary skilled in the art to which the present invention pertains within the spirit and scope of the present invention as hereinafter claimed.

Therefore, the scope of the present invention is not intended to be limited to the embodiments described herein, but should be defined by the appended claims and equivalents of the claims.

What is claimed is:

1. An air pocket module (20) inserted into an air mattress (1), the air pocket module comprising:

a plurality of air pockets (200), each air pocket (200) has a hollow defined therein to be expanded due to air inflow or contracted due to air outflow; and a lower plate (210) coupled below the air pockets (200) to shield the hollow of the air pocket (200), wherein the air pocket (200) comprises:

an upper air pocket (2100), and a lower air pocket (2200) disposed below the upper air pocket (2100) and provided in a regular polygonal column shape having a size greater than that of the upper air pocket (2100), wherein the upper air pocket (2100) comprises:

an upper top surface part (2110) provided in a regular n-polygonal shape (n is an even integer of 6 or greater) when viewed in a plan view;

an upper connection part (2120) connected to the upper top surface part (2110);

upper side surface parts (2130), each upper side surface part (2130) has one end connected to the upper connection part (2120) to extend downward and the other end connected to the lower air pocket (2200); and an upper side surface part connection part (2140) configured to connect the upper side surface parts (2130) to each other; and wherein the lower air pocket (2200) comprises:

a lower connection part (2210) connected to the upper side surface part (2130);

lower side surface parts (2220), each lower side surface part (2220) is disposed below the lower connection part (2210); and a lower side surface part connection part (2230) configured to connect the lower side surface parts (2220) to each other, wherein a bridge (2240) is provided to serve as an air passage between adjacent air pockets (200) on the lower plate (210).

2. The air pocket module of claim 1, wherein the air pockets (200) are disposed to be spaced a predetermined distance from each other in a longitudinal direction and a width direction, and the air pockets (200) of one row in the longitudinal direction and the air pockets (200) in adjacent one row are misaligned with each other along the longitudinal direction, so that a plurality of spaced lines (1) between the air pockets (200) are defined as oblique lines to cross each other.

3. The air pocket module of claim 2, wherein an upper contact part (2111) is disposed in a top surface of the upper top surface part (2110) to protrude upward, wherein the upper contact part (2111) is provided in a shape corresponding to the upper top surface part (2110).

4. The air pocket module of claim 3, wherein:

the upper side surface part (2130) extends downward with a uniform width to extend at an angle θ with respect to the outside of the upper air pocket (2100); and the upper side surface part connection part (2140) also extends downward to extend at the angle θ with respect to the outside of the upper air pocket (2100).

5. The air pocket module of claim 4, wherein an upper reinforcing part (2131) provided in a shape extending in a height direction is disposed in the upper side surface part (2130), wherein the upper reinforcing part (2131) is provided to be recessed inside the upper side surface part (2130) with a width that gradually decreases from the upper connection part (2120) toward a lower portion of the upper side surface part (2130).

6. The air pocket module of claim 5, wherein a rib (2150) is disposed between the upper side surface part (2130) and the lower connection part (2210) to protrude while extending in the height direction.

7. The air pocket module of claim 6, wherein:

the lower side surface part (2220) extends downward with a uniform width to extend at an angle θ with respect to the outside of the lower air pocket (2200); and the lower side surface part connection part (2230) also extends downward to extend at the angle θ with respect to the outside of the lower air pocket (2200).

8. The air pocket module of claim 7, wherein:

the air pocket (200) provided in a regular n-polygonal column shape (n is an even integer of 6 or greater) is disposed in each of an upper portion and a lower portion in the longitudinal direction of the lower plate (210); and the air pocket (200) provided in a regular (n+2)-polygonal column shape (n is an even integer of 6 or greater) is disposed between the upper portion and the lower portion in the longitudinal direction of the lower plate (210).

9. The air pocket module of claim 1, wherein the n is 6.

10. An air mattress provided with the air pocket module of claim 1, the air mattress comprising:

a body (30) in which the air pocket module (10,0) is accommodated; and an air pressure controller (40) configured to control a pressure of the air pocket module (10,20), wherein the body (30) accommodates one or more air pocket modules (10,20), and the air pressure controller (40) comprises:

a controller (41) installed in the body (30);

an air pump (42) connected to and controlled by the controller (41);

a discharge line (43) configured to deliver air discharged from the air pump (42);

a valve part (45) connected to the discharge line (43);

supply lines (46), each of which is connected to the valve part (45); and a nozzle (47) connected to the supply line (46) and installed in the lower plate to serve as an inlet through which the air is supplied to the air pocket (100,200).

11. The air mattress of claim 10, further comprising a pressure sensor (44) installed in the discharge line (43) or each of the supply lines (46) so as to be connected to the controller (41).

* * * * *